United States Patent [19]

Kimberlin

[11] Patent Number: 4,927,323

[45] Date of Patent: May 22, 1990

[54] RADIAL FLOW FLUID PRESSURE MODULE

[75] Inventor: Robert R. Kimberlin, Athens, Pa.

[73] Assignee: Ingersoll-Rand Company, Woodcliff Lake, N.J.

[21] Appl. No.: 291,184

[22] Filed: Dec. 28, 1988

[51] Int. Cl.[5] ..... F01D 3/02

[52] U.S. Cl. ..... 415/98; 415/132; 415/201; 415/214.1

[58] Field of Search ..... 415/93, 97, 98, 101, 415/102, 129, 131, 132, 133, 214.1, 87, 86, 83, 170.1, 201; 416/184, 199

[56] References Cited

U.S. PATENT DOCUMENTS

| | | | |
|---|---|---|---|
| 715,441 | 12/1902 | Vandegrift | 415/87 |
| 773,136 | 10/1904 | Farrand et al. | 415/87 |
| 1,017,438 | 2/1912 | McAuley | 415/87 |
| 1,158,978 | 11/1915 | Buchi | 415/98 |
| 2,775,208 | 12/1956 | Mueller | 415/98 |
| 3,334,863 | 8/1967 | Engvall | 415/170.1 |
| 3,357,361 | 12/1967 | Scott | 415/101 |
| 3,457,869 | 7/1969 | Janetz | 415/98 |
| 3,892,500 | 7/1975 | Miller et al. | 415/108 |
| 4,439,096 | 3/1984 | Rockwood et al. | 415/132 |
| 4,563,124 | 1/1986 | Eskew | 415/102 |

FOREIGN PATENT DOCUMENTS

| | | | |
|---|---|---|---|
| 333309 | 11/1958 | Switzerland | 415/102 |
| 5022 | 12/1879 | United Kingdom | 415/87 |

*Primary Examiner*—Robert E. Garrett
*Assistant Examiner*—John T. Kwon
*Attorney, Agent, or Firm*—Robert F. Palermo; Arthur N. Trausch; Walter C. Vliet

[57] ABSTRACT

A radical flow mechanism is provided having a symmetric housing assembly defining a hollow rotor chamber. A symmetric shaft and rotor assembly is supported for rotation in the rotor chamber. A plurality of radial flow paths are defined by the rotor and the housing assembly. The assembled module may be powered by a pressurized motive fluid that flows radially inward to rotate the rotor. Alternatively, the rotor may be driven by an external power source so that a working fluid increases in potential energy as it moves centrifugally outward. The assembled module is symmetric about the rotor member so that the rotor can be orientated for either direction of rotation and so that power takeoff or power connection can be to either side of the module. Also, the module is constructed so that the seals are located at an interface having a low pressure differential and the bearings are located adjacent an area encouraging heat dissipation.

12 Claims, 2 Drawing Sheets

RADIAL FLOW FLUID PRESSURE MODULE

FIELD OF THE INVENTION

This invention relates to a radial flow fluid pressure module and more particularly to a module which can be used in radial flow turbomachinery such as a centripetal turbine motor or a centrifugal fluid pressurizer.

BACKGROUND OF THE INVENTION

Turbomachinery refers to fluid pressure mechanisms for producing pressure or power whose primary elements are rotative as opposed to reciprocating. A turbine motor is a fluid pressure mechanism whose rotor is driven by a pressurized motive fluid to produce a rotary mechanical output. A rotary fluid pressurizer such as a centrifugal compressor, pump, blower, or fan is a fluid pressure mechanism whose rotor is driven by an external power source to increase the potential energy of a working fluid. Thus as used herein, a fluid pressure mechanism can refer to either a turbine motor or a fluid pressurizer.

A rotary pressure mechanism can have many different flow configurations. For example, in an axial flow mechanism the fluid flows axially through radially extending blades on the rotor element. In a one-faced radial flow mechanism, the fluid flows substantially radially through axially extending blades on one side of the rotor element. In a two-faced radial flow mechanism, the fluid flows radially on both sides of the rotor element through axially extending blades. For radial flow mechanisms, the fluid flow can be radially inward or radially outward. Additionally, all of the above pressure mechanisms can have single or multiple stages of blades.

For certain turbomachinery uses, a two-faced radial flow configuration has advantages over the alternative configurations. For example, radial loads can be inherently balanced. Additionally, the axial thrust loads on the rotor and shaft can be minimized since the fluid loading on the opposed faces of the rotor is balanced. Finally, a two-faced rotor allows a compact package for a desired fluid pressure or power output.

A centripetal turbine motor and a centrifugal fluid pressurizer differ in operation only in that the fluid flow is radially opposite. In spite of this, known two-faced centripetal turbine motors and centrifugal fluid pressurizers differ substantially in construction. Many similarly functioning parts are unnecessarily constructed differently for the different modes of operation.

Additionally, for known mechanisms, the orientation of the mechanism determines the direction of the shaft rotation. A differently constructed mechanism is required to provide shaft rotation in the reverse direction.

Likewise, for known mechanisms, the power takeoff/drive connection is limited to one side of the mechanism. Major reconstruction or a differently constructed unit is required to reverse the side of the power takeoff or the power drive connection.

In high speed turbomachinery, a seal is needed to separate the working or motive fluid areas from the lubricated areas to prevent cross contamination. A seal that is located at an interface having a large pressure differential requires a more complex and thus more expensive construction. Also high pressure seals may produce more unwanted frictional heat.

Likewise, if the bearings are located in a position from which it is difficult to dissipate heat, more durable and expensive bearings are required.

The present invention provides several advantages over known fluid pressure mechanism construction and overcomes various disadvantages of presently known fluid pressure mechanisms.

SUMMARY OF THE INVENTION

It is a primary object of this invention to provide a radial flow fluid pressure mechanism that is simple and economical to manufacture and assemble.

It is another object of this invention to provide a radial flow fluid pressure mechanism having modular construction and minimal parts.

It is an object of this invention to provide a radial flow fluid pressure module that is capable of operating as either a turbine motor or a fluid pressurizer.

It is a feature of this invention that the assembled module can be orientated for shaft rotation in either direction.

It is another feature of this invention that the assembled module can have power take-off or power connection to either side.

It is an advantage of this invention to provide a modular construction which positions the seals at an interface location having a low pressure differential.

It is another advantage of this invention to provide a modular construction which inherently encourages heat dissipation from the bearings.

In general, the foregoing objects are obtained in a radial flow mechanism having a symmetric housing assembly defining a hollow rotor chamber. A symmetric shaft and rotor assembly is supported for rotation in the rotor chamber. A plurality of radial flow paths are defined by the rotor and the housing assembly. The assembled module may be powered by a pressurized motive fluid that flows radially inward to rotate the rotor. Alternatively, the rotor may be driven by an external power source so that a working fluid increases in potential energy as it moves centrifugally outward.

Additionally, the assembled module is symmetric about the rotor member so that the rotor can be orientated for either direction of rotation and so that power takeoff/drive connection can be to either side of the module.

Finally, the fluid pressure mechanism is constructed so that the seals are located at an interface having a low pressure differential and the bearings are located adjacent an area encouraging heat dissipation.

BRIEF DESCRIPTION OF THE DRAWINGS

Other objects, features, and advantages of the present invention will become more fully apparent from the following detailed description of the preferred embodiment, the appended claims and the accompanying drawings in which:

DESCRIPTION OF THE PREFERRED EMBODIMENT

The present invention is related to commonly assigned Ser. No. 07/291,183 titled "Radial Flow Rotor Assembly" and filed concurrently with this application and hereby incorporated by reference into this application.

Figure 1:
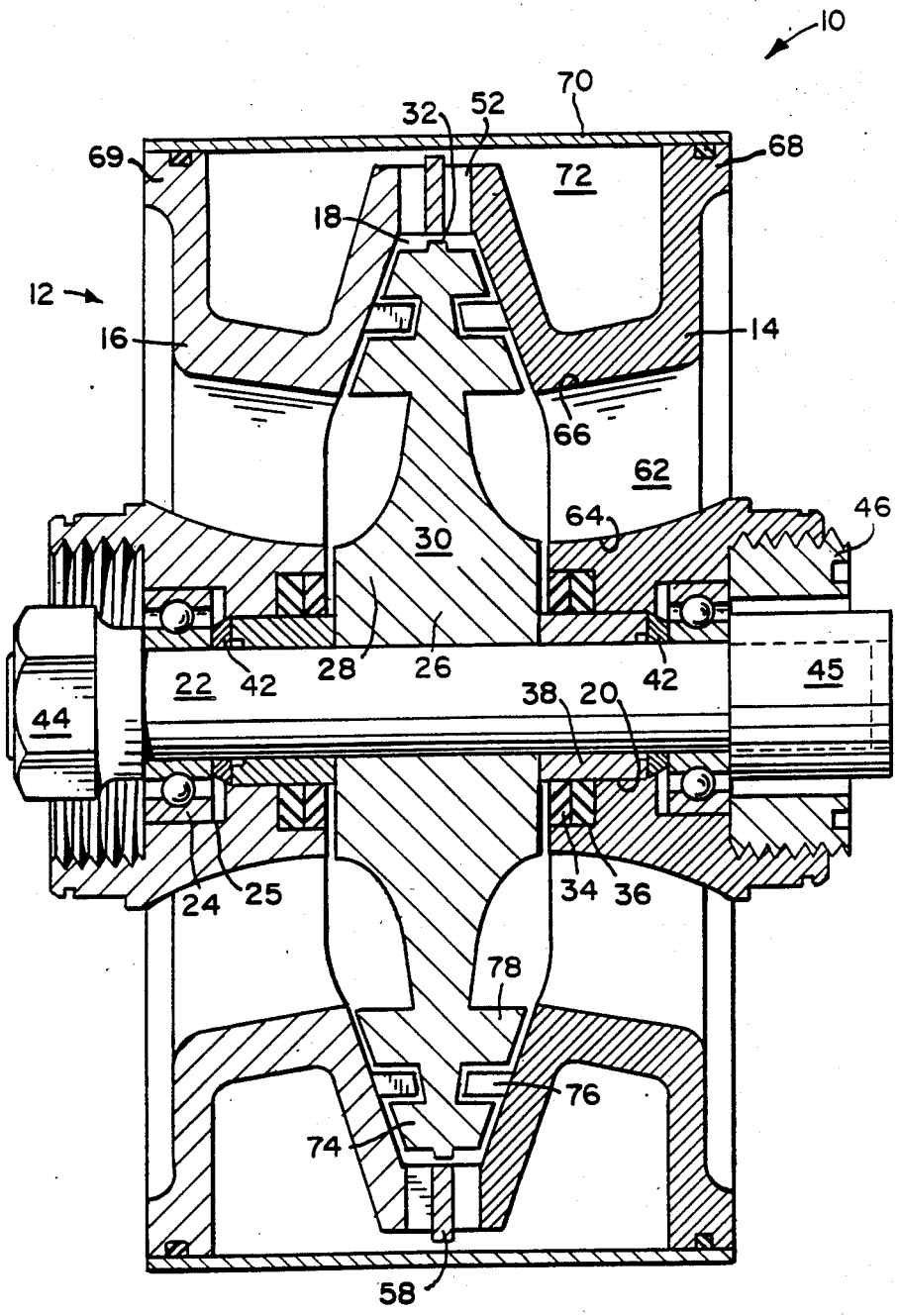
FIG. 1 is a longitudinal sectional view of the radial flow fluid pressure module of the present invention.

Referring now to FIG. 1 of the drawings, the assembly and operation of the preferred embodiment of a radial flow fluid pressure module 10 will now be described. As used in this description, a module is a standard unit of assembled components for use in a complete machine. A fluid pressure module is a module having a rotor either rotated by a pressurized motive fluid to produce rotary mechanical output, such as a turbine motor, or a rotor driven by an external power source to produce high pressure, low velocity fluid such as in a centrifugal compressor or pump or high velocity, low pressure fluid, such as in a centrifugal fan or blower.

The module 10 includes a symmetric housing assembly 12 which is composed of mateable right and left housing members 14 and 16. The housing members are mirror images of each other. The housing assembly is the primary stationary part of the module. A hollow rotor chamber 18 is formed on the interior of the housing assembly between the mated housing members. An opening 20 extends longitudinally through the center of the housing assembly.

A rotor shaft 22 having one right hand and one left hand threaded end is supported for rotation in the longitudinal opening of the housing assembly by two suitable bearings 24. The bearings are mounted in integrally formed outer shoulder recesses 25 on the outside faces of each housing member. A rotor member 26 having a center bore is mounted on the shaft for rotation with the shaft in the rotor chamber. The rotor member has a thick hub portion 28 concentric with the center bore. A radially extending disc portion 30 has two opposed faces which smoothly converge to a thin outer tip surface 32. The thick hub portion allows more even stress distribution at the bore of the rotor. The rotor is typically press fit on the shaft. The tapered disk portion reduces the weight and mass at the outer circumferential surface of the rotor member where the tip speeds are the highest and the centrifugal forces are the greatest.

A pair of annular seals 34 are mounted in integrally formed inner shoulder recesses 36 in the housing members to sealingly contact the rotor assembly. Bearing spacers 38 are press fit onto the shaft to abut the rotor. The stationary seals contact the outer circumferential surface of the rotating spacers 38 to provide a seal at a low pressure interface between the rotor assembly and housing.

The rotating components are axially positioned and centered inside the housing assembly by use of an adjusting mechanism. Axially resilient spacing members 42 are positioned in the integrally formed outer shoulder recesses 25 between each housing member and each bearing 24. A retainer member such as an appropriately threaded nut 44 is threaded in position on one threaded end of the rotor shaft 22 so as to abut one bearing. A second retainer 45 such as an appropriately threaded power take-off/drive connection member is threaded onto the other end of the shaft so as to abut the second bearing and clamp the rotating components together. An exteriorly threaded adjusting nut 46 is then positioned in a threaded flange on the housing member. The shaft and rotor assembly including both bearings 24 and bearing spacers 38 can then be moved relative to the housing by the adjusting nut to axially center the rotor 26 in the rotor chamber.

Figure 2:
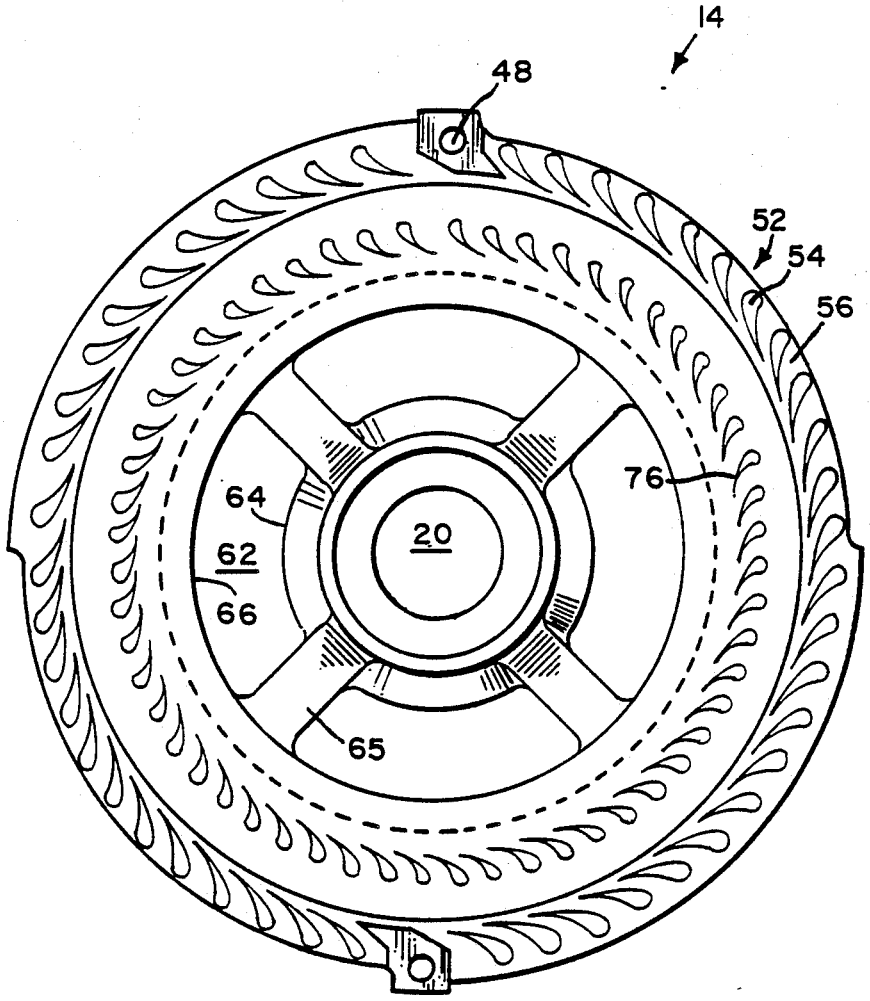
FIG. 2 is an end view of one housing member.

The housing assembly 12 is constructed of two essentially mirror-image right and left hand housing members 14 and 16, one shown in FIG. 2. The members are joined together by suitable means such as thru bolts at 48 to form the housing assembly in which the rotor member rotates.

Outer radial openings 52 are provided circumferentially in each housing member for fluid communication between the exterior of the housing assembly and the rotor chamber. A first set of integrally formed nozzles 54 which axially extend from each housing member are positioned in the radial opening to divide the opening into individual nozzle openings 56. A circumferential spacing ring 58 having a thickness approximate to the thickness of the rotor tip 32 is positioned in the radial opening 52 between the housing members. The spacer ring 58 defines separate nozzle openings for each face of the rotor member.

A pair of opposed axial passages 62 are also in fluid communication with the inner portion of the rotor chamber. The passages are annular and circumscribe the seals 34 and bearings 24. The inner annular surface 64 of the axial passage is supported by struts 65 from the outer annular surface 66.

The outer annular surface 66 of each housing members 14 and 16 has annular flanges 68 and 69 respectively which extend radially outward from the housing assembly. A cylindrical plenum member 70 extends circumferentially between the flanges. The plenum member is in circumferential sealing contact with both flanges and thus forms a plenum chamber 72 with the exterior of the housing members. The plenum chamber is in fluid communication with the radial openings 52. The plenum member also has appropriate openings to the exterior of the module.

Axially extending from the opposed faces of the turbine disk portion 30 are a first circular row of turbine blades 74. These blades are arranged in a circular pattern on each face of the rotor member. The first row of blades 74 and the first set of nozzles 54 are arranged concentrically and are generally radially adjacent so as to be in radial fluid communication with each other.

A second and successive sets of nozzles 76 may axially extend from each housing member into the rotor chamber. A second and successive circular rows of axially extending rotor blades 78 may be positioned on each face of the rotor member concentric with and radially inward from the first row of blades 74. All the blade rows and nozzle sets are concentric and are arranged alternatively with each other. Adjacent blade rows and nozzle sets have minimal radial clearances. The blade tips have minimal axial clearance with the sides of the rotor chamber 18 and the nozzle tips have minimal axial clearance with the faces of the rotor member. Thus a plurality of radially directed flow paths are defined by the rotor blades and the nozzles of the housing members.

The method of assembling the radial flow fluid pressure module 10 of the present invention will now be described. A symmetric shaft and rotor assembly is provided as a subassembly. One suitable shaft and rotor assembly is that described in Ser. No. 07/291,183 titled "Radial Flow Rotor Assembly" filed concurrently with this application and previously incorporated by reference in this application. The shaft and rotor assembly includes a shaft 22 having two threaded ends. A rotor member 26 is mounted or can be integrally formed on the center of the shaft. Bearing spacers 38 are also provided on the shaft and rotor assembly.

The first step in assembling a module is to position an annular seal 34 in the integrally formed inner shoulder recess of each housing member. One housing member 14 and 16 is then positioned on each end of the rotor assembly shaft with the spacer ring 58 between them so that the rotor is enclosed in the rotor chamber. The ends of the shaft project through the seals 34 and protrude out the longitudinal opening 20 in each housing member. Next a resilient spacing member 42 and a bearing 24 is positioned on each protruding end of the shaft so as to fit within the integrally formed shoulder recess 25 of each housing member. The appropriately threaded retainers 44 and 45 are fixed on each end of the shaft so as to axially clamp the rotating components together. The adjusting nut 46 is then threaded into the housing member on an appropriate side so as to axially center the rotor assembly within the rotor chamber. As a final step the cylindrical plenum member 70 is sealingly positioned on the radially extending flanges 68 and 69 so as to form a plenum chamber 72.

The fluid pressure module 10 will now be described in operation as a turbine motor. A pressurized motive fluid is introduced from a suitable source into the plenum chamber 72. The motive fluid flows generally radially through the first set of nozzles 54. These inlet nozzles turn the motive fluid to a more tangential direction to act on the first row of turbine blades 74. The motive fluid acts on the first stage of blades in an impulse manner. The motive fluid then enters the second set of nozzles 76 which also tangentially directs the fluid to the second row of blades 78. The motive fluid acts on the second stage of blades in an impulse manner. On exiting the second or final row of blades the motive fluid is smoothly turned to a more axial direction by the diverging faces of the rotor disk portion 30. The spent motive fluid then enters the axial exhaust passages 62. The exhaust fluid is now at a reduced pressure and temperature due to the fluid expansion while moving through the turbine blades and nozzles.

The seals 34 which seal the interface between the stationary housing and the rotating rotor are located radially adjacent and are circumscribed by the low pressure exhaust passages 62. Thus the seals 34 can have a simple construction since they need only seal against a low pressure differential.

Likewise, the bearings 24 which support the shaft for rotation are also located radially adjacent the exhaust passage 62. The heat generated in the bearings will be pulled to the lower temperature portion of the exhaust passage 62 which circumscribes the bearings.

The fluid pressure module 10 can also be operated as a fluid pressurizing machine such as a centrifugal compressor or blower, which will now be described.

A working fluid such as air enters the axial inlet passages 62. The air is typically at ambient temperature and pressure and thus the seals 34 need only seal against a small pressure differential. The heat generated by rotating parts such as the bearings 24 will be drawn away from the bearings to the lower temperature axial passages 62. The shaft 22 and rotor member 26 are driven by a suitable power source. As the working fluid moves through the row of blades 78, the fluid increases in pressure and/or velocity. As the working fluid continues to move radially outward through nozzles 76 and blades 74 of the flow paths, the fluid is further increased in pressure and/or velocity. When the fluid exits the nozzles 54 it is at a higher fluid pressure and/or fluid velocity than the ambient inlet air.

The fluid pressure module 10 can be readily assembled without concern for the rotational direction of the shaft or the accessibility of the power take-off or drive connection. Since it is symmetric, the entire module can be turned 180° for left hand or right hand shaft rotation. Additionally, a power take-off or drive connection can be connected to either the right or left side of the rotor shaft.

Since the outer shoulder recesses for the rotor shaft bearings and the inner shoulder recesses for the rotor shaft seals are integrally formed with the mateable housing members, precise radial centering of the rotor assembly within the rotor chamber is automatic. Precise axial centering is easily obtained using the adjusting nut. This radically simplifies assembly of the module when compared to housings in which multicomponent housing shell halves are used.

Changes and modifications in the specifically described embodiments can be carried out without departing from the spirit and scope of the invention which is intended to be limited only by the scope of the following claims:

I claim:

1. A radial flow fluid pressure module comprising:

a symmetric housing assembly formed by two mateable housing members and having a hollow rotor chamber formed between the mated housing members;

radial openings in the radial periphery of said rotor chamber through each housing member;

opposed annular passages axially extending from the inner portion of said rotor chamber through each housing member;

a shaft supported for rotation in said housing assembly;

a rotor having opposed faces and mounted on said shaft for rotation with said shaft in said rotor chamber;

at least one circular row of axially cantilevered blades mounted on each face of said rotor;

a least one set of integrally formed nozzles axially extending from each housing member and arranged radially concentric and adjacent to a respective row of rotor blades such that each set of nozzles is in fluid communication with said respective row of rotor blades;

a plurality of radially directed flow paths defined by said rotor and said housing members; and an annular plenum chamber circumferentially surrounding said housing assembly, in fluid communication with said radial openings, and further comprising:

a pair of annular flanges, one flange extending radially outward from each housing member; and a cylindrical member in circumferential sealing contact with both flanges.

2. The module of claim 1, further comprising:

bearing means for rotatably supporting said shaft in said housing assembly, said bearing means located radially adjacent a low temperature portion of said annular passages; and sealing means for sealing an interface between the rotor and the housing assembly, said sealing means located radially adjacent a low pressure portion of said annular passages.

3. The module of claim 2, wherein said annular passages circumscribe said bearing means and said sealing means.

4. The module of claim 3, further comprising a set of integrally formed nozzles axially extending from each housing member into said radial openings.

5. The module of claim 4, wherein said flow paths are directed radially inward and said radial openings are adapted for communication with a source of pressure fluid so that the pressure fluid causes said rotor to rotate.

6. The module of claim 4, wherein said shaft is adapted to be rotated by an external force and said annular passages are adapted for communication with a source of ambient fluid and said flow paths are directed radially outward so that the fluid from said annular passages is rotated by said rotor and increases in one of pressure and velocity as the fluid moves radially outward through the flow paths.

7. A radial flow fluid pressurizing module comprising:

a symmetric housing assembly formed by two mateable housing members and having a hollow rotor chamber formed between the mated housing members;

radial outlet openings in the radial periphery of said rotor chamber through each housing member;

opposed annular inlet passages axially extending from the inner portion of said rotor chamber through each housing member;

a shaft supported for rotation in said housing assembly;

a rotor having opposed faces and mounted on said shaft for rotation with said shaft in said rotor chamber;

at least one circular row of axially cantilevered blades mounted on each face of said rotor;

at least one set of integrally formed nozzles axially extending from each housing member and arranged radially concentric and adjacent to a respective row of rotor blades such that each set of nozzles is in fluid communication with said respective row of rotor blades;

a plurality of radially outward directed flow paths defined by said rotor and said housing members; and an annular plenum chamber circumferentially surrounding said housing assembly, in fluid communication with said radial outlet openings, and further comprising:

a pair of annular flanges, one flange extending radially outward from each housing member; and a cylindrical member in circumferential sealing contact with both flanges.

8. The fluid pressure module of claim 7, further comprising:

bearing means for rotatably supporting said shaft in said housing assembly, said bearing means located radially adjacent a low temperature portion of said inlet passages; and sealing means for sealing an interface between the rotor and the housing assembly, said sealing means located radially adjacent a low pressure portion of said inlet passages.

9. The fluid pressure module of claim 8, wherein said inlet passages circumscribe said bearing means and said sealing means.

10. The fluid pressure module of claim 9, further comprising a set of integrally formed nozzles axially extending from each housing member.

11. A method of assembling a radial flow fluid pressure module having a symmetric shaft and rotor assembly and two mateable, mirror-image housing members having inside surfaces defining a hollow rotor chamber, comprising the steps of:

placing a rotor shaft seal in an integrally formed locating recess and stop on each of the two mateable housing members;

placing a resilient spacer and a rotor shaft bearing in an integrally formed locating recess and step on each of the two mateable housing members;

positioning one housing member on each end of the shaft and rotor assembly so that the rotor is enclosed in said rotor chamber and the ends of the shaft protrude through the sealing means and the housing members;

fixing a retaining member on each end of the shaft to axially abut and position the bearings on the shaft;

adjustably positioning an adjusting member relative to one housing member so as to axially position and center the rotor assembly within the rotor chamber;

placing one elastomeric sealing ring on each annular flange, one flange extending radially outward from each housing member; and placing a cylindrical member about both flanges in circumferential sealing contact to form an annular plenum chamber circumferentially surrounding said housing assembly and in fluid communication with radial openings in the radial periphery of said rotor chamber.

12. A radial flow turbine motor module comprising:

a symmetric housing assembly formed by two mateable housing members and having a hollow rotor chamber formed between the mated housing members;

radial inlet openings in the radial periphery of said rotor chamber through each housing member;

a shaft supported for rotation in said housing assembly;

a rotor having opposed faces and mounted on said shaft for rotation with said shaft in said rotor chamber;

at least one circular row of axially cantilevered blades mounted on each face of said rotor;

at least one set of integrally formed nozzles axially extending from each housing member and arranged radially concentric and adjacent to a respective row of rotor blades such that each set of nozzles is in fluid communication with said respective row of rotor blades;

a plurality of radially inward directed flow paths defined by said rotor and said housing members;

opposed annular exhaust passages axially extending from the inner portion of said rotor chamber through each housing member;

bearing means for rotatably supporting said shaft in said housing assembly, said bearing means located radially adjacent and circumscribed by a low temperature portion of said exhaust passage; and sealing means for sealing an interface between the rotor and the housing assembly, said sealing means located radially adjacent and circumscribed by a low pressure portion of said exhaust passage;

a set of integrally formed nozzles axially extending from each housing member into said radial openings;

an annular plenum chamber circumferentially surrounding said housing assembly, in fluid communication with said radial inlet openings, and further comprising:

a pair of annular flanges, one flange extending radially outward from each housing member; and a cylindrical member in circumferential sealing contact with both flanges.

* * * * *